US006808127B2

(12) United States Patent
McNulty et al.

(10) Patent No.: US 6,808,127 B2
(45) Date of Patent: Oct. 26, 2004

(54) SPRINKLER HEAD ASSEMBLY FOR UNDERGROUND SPRINKLER SYSTEM

(75) Inventors: Edward L. McNulty, Midland, VA (US); Gary A. Cordova, Catlett, VA (US); James Meier, Stafford, VA (US)

(73) Assignee: JEG, Inc., Midland, VA (US)

( * ) Notice: Subject to any disclaimer, the term of this patent is extended or adjusted under 35 U.S.C. 154(b) by 285 days.

(21) Appl. No.: 10/013,357

(22) Filed: Dec. 13, 2001

(65) Prior Publication Data

US 2003/0111549 A1 Jun. 19, 2003

(51) Int. Cl.[7] ..... B05B 15/10
(52) U.S. Cl. ..... 239/205; 239/67; 239/569
(58) Field of Search ..... 239/201–206, 239/67, 69, 70

(56) References Cited

U.S. PATENT DOCUMENTS

| | | | | |
|---|---|---|---|---|
| 1,863,919 A | | 6/1932 | Brooks | |
| 1,962,534 A | * | 6/1934 | Sweetland | 239/201 |
| 2,031,754 A | | 2/1936 | Bacigalupi | |
| 3,317,144 A | * | 5/1967 | Muschett | 239/204 |
| 3,343,796 A | | 9/1967 | Trickey | |
| 3,762,437 A | | 10/1973 | King, Sr. | |
| 3,776,463 A | | 12/1973 | Dyck | |
| 4,699,321 A | | 10/1987 | Bivens et al. | |
| 4,763,837 A | | 8/1988 | Livneh | |
| 4,875,498 A | * | 10/1989 | Andrews et al. | 137/78.3 |
| 4,953,581 A | | 9/1990 | Patterson | |
| 5,123,597 A | | 6/1992 | Bendall | |
| 5,938,121 A | | 8/1999 | Ferguson et al. | |
| 5,996,905 A | | 12/1999 | Bedford | |
| 6,050,500 A | | 4/2000 | Ensworth | |
| 6,138,924 A | | 10/2000 | Hunter et al. | |
| 6,193,168 B1 | | 2/2001 | Bedford | |
| 6,227,455 B1 | * | 5/2001 | Scott et al. | 239/1 |
| 6,301,723 B1 | * | 10/2001 | Goettl | 4/490 |
| 6,467,498 B1 | * | 10/2002 | Esmailzadeh | 137/238 |

* cited by examiner

*Primary Examiner*—Christopher Kim
(74) *Attorney, Agent, or Firm*—Diederiks & Whitelaw, PLC

(57) ABSTRACT

A pop-up sprinkler assembly includes a housing cover which is readily, vertically adjustable relative to a main housing within which extends a sprinkler head unit arranged in an adapter sleeve that is interengaged with the main housing to establish a blow-out feature. A readily accessible, preferably threadably mounted solenoid is used to control a main water flow valve positioned below an associated frost line. A dirt shield protects the solenoid, as well as a releasable connection between the main housing and the housing cover, from contamination. A hose adapting element is provided to be selectively secured about the sprinkler head unit atop the housing cover.

24 Claims, 6 Drawing Sheets

SPRINKLER HEAD ASSEMBLY FOR UNDERGROUND SPRINKLER SYSTEM

BACKGROUND OF THE INVENTION

1. Field of the Invention

The present invention pertains to the art of irrigation and, more particularly, to the mounting and configuration of a sprinkler head assembly of an overall underground sprinkler system.

2. Discussion of the Prior Art

Underground sprinkler systems are becoming more prevalent in new home designs. However, such systems have been commonly used in other environments for quite a long time. For example, resorts and golf courses have employed underground sprinkler systems for decades. In general, a sprinkler system includes one or more underground sprinkler heads interconnected to a water supply line through respective risers. Because it is often desired to arrange the sprinkler head substantially flush with the surrounding terrain and the depth to which the main supply line is buried can vary between different installations, risers will have varying, associated lengths. Regardless of this fact, it is not atypical for a flush mounted sprinkler head to become recessed relative to the surrounding ground surface. This potential problem can be particularly found in connection with golf courses wherein the sprinkler heads are often run over by work and other transport vehicles. In order to be most effective, the proper level of the sprinkler head must be maintained.

For at least this reason, it is sometimes necessary to excavate about a recessed or sunken sprinkler head and associated riser such that the length or positioning of the riser can be adjusted in order to reset the desired height for the sprinkler head. Obviously, this represents a time consuming and expensive undertaking. To address this concern, it has heretofore been proposed to provide for some adjustability of a sprinkler head itself. In such known arrangements, a sprinkler head can be vertically adjusted relative to its riser to a limited degree. Typically, these known adjustment systems require a much lower degree of excavation or component disassembly. An example of such a known arrangement is disclosed in U.S. Pat. No. 5,938,121. Regardless of the prior art which addresses this problem, there still exists a need in the art for an improved adjustment arrangement for sprinkler heads.

In addressing this and other needs in the art, it is considered important to provide an overall sprinkler head arrangement which can be readily adapted for use with a wide range of conventional pop-up head units. In addition, in most environments, underground sprinkler systems must be drained during the colder months of the year in order to avoid freezing. Obviously, it would be desirable to not require this laborious task. Furthermore, one major maintenance item in sprinkler systems is replacing faulty solenoid control valves. It would be extremely beneficial to simplify this maintenance function, which typically also requires excavating about a respective sprinkler head.

In a typical underground sprinkler system, particularly for a large-scale installation, it is extremely common to install, adjacent a select few of the overall number of sprinkler heads connected to a common water supply line, separate hose attachments. In this manner, hose attachments are readily available for use in connection with watering areas not directly covered by the various sprinkler heads or for other reasons. Certainly, the need to incorporate these separate links to the water supply line increases the installation time and expense associated with the sprinkler system, as well as complicates the overall system design. To this end, it would be advantageous to provide structure which could be employed to selectively convert a pop-up sprinkler head to a hose connection, thereby avoiding the requirement for separate hose attachments which carry with them further winterizing needs.

Based on the above, there exists a need for various improvements in the art of underground sprinkler systems, particularly with respect to providing convenient arrangements for readily, vertically adjusting a sprinkler head, avoiding the need to drain an overall sprinkler system during winter months, accommodating any one of a wide range of sprinkler head units in a single sprinkler housing, simplifying solenoid valve replacement, and enabling a pop-up sprinkler head to be easily converted to a hose attachment as needed.

SUMMARY OF THE INVENTION

The present invention is directed to an adjustable pop-up sprinkler head arrangement used in connection with underground irrigation systems, such as those employed at golf courses. In accordance with the invention, a main sprinkler housing is placed in fluid communication with a main supply line through a riser. A flow valve is adapted to control the flow of water to the main housing, while being located at a position below a frost line of the system. The main housing has an upper opening adapted to receive a portion of a pop-up sprinkler head unit through an adapter sleeve which establishes a blow-out feature. The sprinkler head has associated therewith a readily accessible, threadably attached or otherwise quick connected solenoid for controlling the opening and closing of the flow valve, as well as a shield that extends concentrically about a body portion of the main housing, with the shield preventing the ingress of dirt between the shield and the body portion.

The pop-up sprinkler head unit is vertically adjustable relative to the main housing and can be retained in an infinite number of vertical positions between extreme raised and lowered positions, preferably through a wedge-type connection established by exposed heads of various mechanical fasteners associated with a retainer ring. This arrangement not only allows for the adjustability of the head, but also provides an adjustable resistance to the lowering of the head relative to the surrounding terrain. If the head should become lowered relative to the ground surface, the head can be easily, vertically adjusted to re-establish a flush mounting arrangement.

The sprinkler head assembly has associated therewith a weep hole which enables draining of the water above the valve whenever the valve is shut off. The weep hole is positioned below the frost line such that no water is normally in the main housing of the sprinkler head. This arrangement avoids the need for winterizing the sprinkler head. Given the incorporation of the adapter sleeve used to mount a particular pop-up sprinkler head unit within the main housing, the overall system can be adapted for use with various known pop-up sprinkler head units available on the market today by simply employing a respective, particularly designed adaptor sleeve.

In accordance with a still further aspect of the invention, a cover or cap for the sprinkler head includes structure enabling a container type element to be mounted over the pop-up sprinkler head. More particularly, the container has one end which is adapted to be fluidly sealed about the retainer ring of the sprinkler head and a second end which defines a threaded connection for a hose. With this arrangement, the container can be selectively attached to the sprinkler housing such that, when the pop-up sprinkler is operating, water will be directed out the second end of the container and through the hose connection. This construction avoids the need for separate hose attachments adjacent sprinkler heads as part of an overall underground watering system.

Additional objects, features and advantages of the present invention will become more readily apparent from the following detailed description of a preferred embodiment when taken in conjunction with the drawing wherein like reference numerals refer to corresponding parts in the several views.

DETAILED DESCRIPTION OF THE PREFERRED EMBODIMENT

Figure 1:
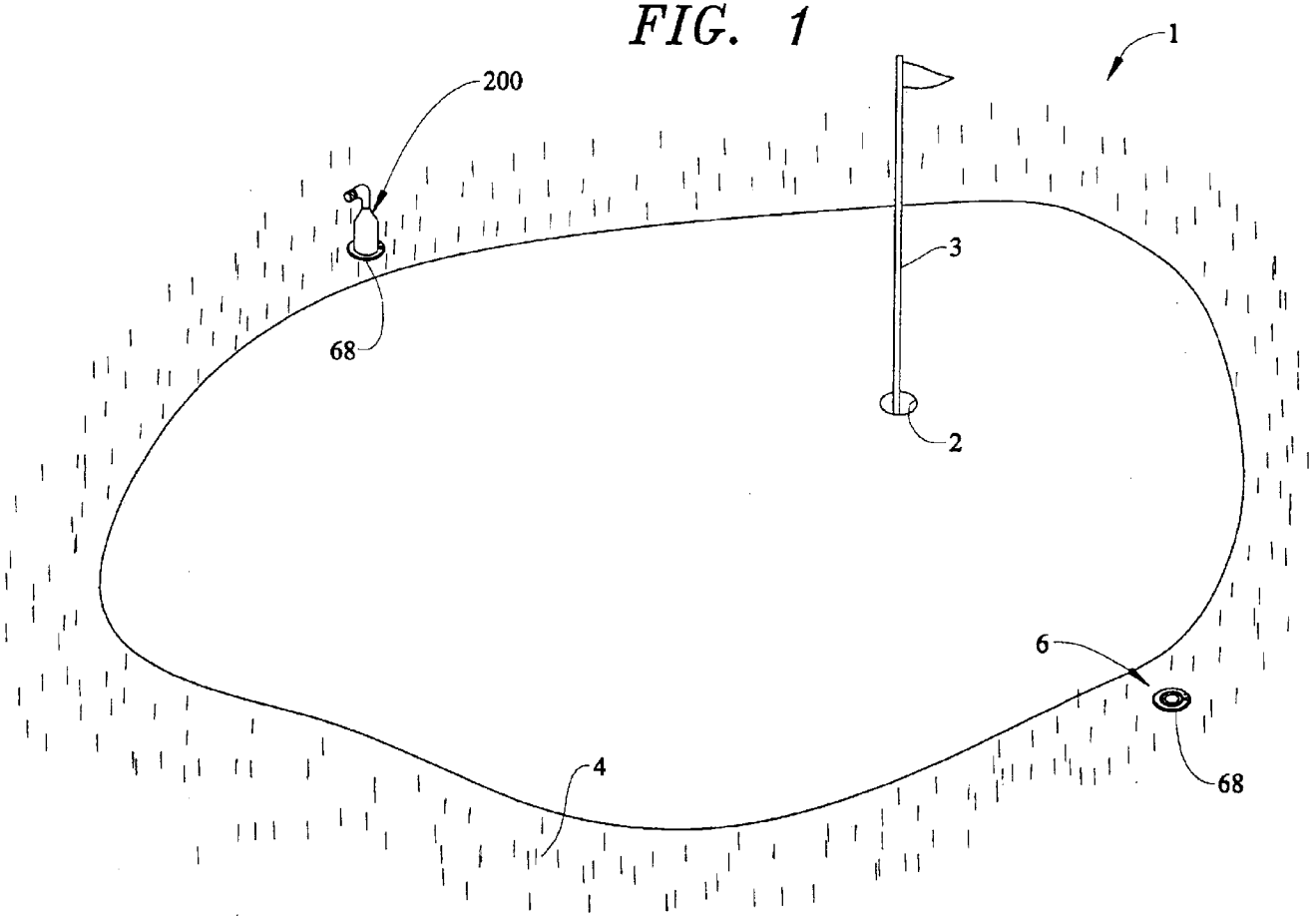
FIG. 1 is a perspective view of an area about a hole at a golf course wherein two of the sprinkler head assemblies of the present invention are installed.
Figure 2:
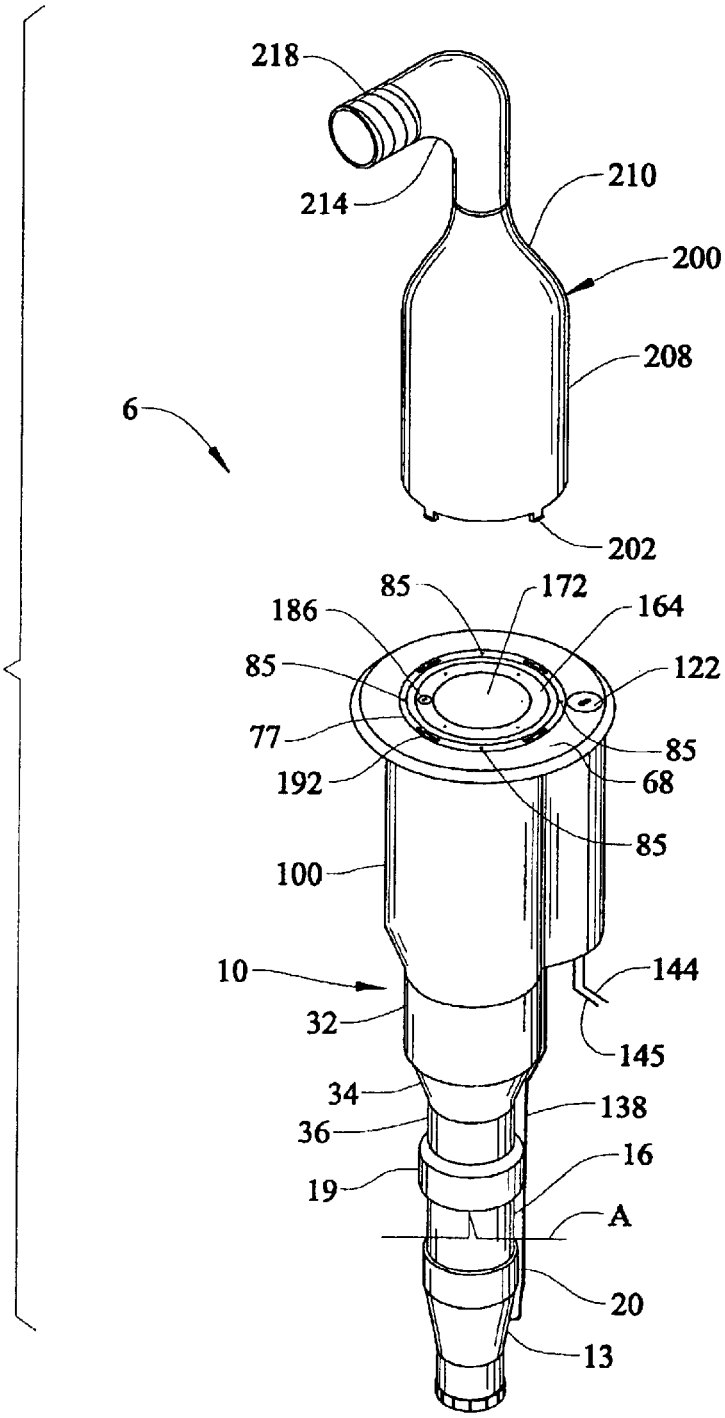
FIG. 2 is a partial exploded view, showing the sprinkler head assembly and an associated hose attachment container in accordance with the invention.

With initial reference to FIG. 1, the present invention is generally shown for use at a green 1 of a golf course. To this end, FIG. 1 depicts a hole 2 having extending therefrom a pin 3 associated with green 1. About green 1 is a higher cut grassy area generally referred to as a "first cut" 4. Located in first cut 4, on generally opposing sides of green 1, are buried sprinkler head assemblies 6 constructed in accordance with the present invention. Prior to describing in detail the preferred construction of sprinkler head assembly 6, it should be initially noted that the use of sprinkler head assembly 6 in connection with green 1 only represents a single, preferred use of the invention. As will become more fully apparent from the following detailed discussion of the invention, sprinkler assembly 6 can be employed in a wide range of environments wherever an underground sprinkler system is desired.

Reference will now be made to FIGS. 2, 3, 4A and 4B in describing the preferred construction of sprinkler head assembly 6. As shown, sprinkler head assembly 6 includes a main housing 10 which is connected to a lower valve housing 13 through a conduit 16. As will become more evident below, the actual length of conduit 16 can vary in accordance with the present invention, particularly dependent upon the depth of a frost line, generally represented by line A in FIG. 3, in the particular geographic region in which sprinkler head assembly 6 is employed. In any event, at this point, it is important to note that main housing 10 is preferably arranged above frost line A, while lower valve housing 13 is arranged below frost line A. In accordance with the most preferred embodiment of the invention, either threaded or glued couplings 19 and 20 are utilized in interconnecting conduit 16 to main housing 10 and lower valve housing 13 respectively. In the most preferred embodiment of the invention, couplings 19 and 20, as well as main housing 10, lower valve housing 13 and conduit 16, are formed from plastic, such as PVC.

Main housing 10 is formed with an upper, in-turn flange 26 that defines a central opening 27 and a pair of associated slots 29 and 30. Main housing 10 also includes a cylindrical body portion 32 that leads from in-turn flange 26 to a lower, tapered section 34. In the embodiment shown, tapered section 34 leads to a terminal end 36 which is threadably attached to coupling 19.

Arranged in lower valve housing 13 and accessible through central opening 27 is a main water supply valve 40. The actual construction of valve 40 is known in the art such that the internal structure thereof will not be described in detail here. However, the positioning of valve 40 within lower valve housing 13 below frost line A, as well as the operation of valve 40 in connection with the overall invention, is of concern. As shown, valve 40 includes a bleeder line stem 42 that leads to a passage 44 formed in lower valve housing 13. Lower valve housing 13 is interconnected through an articulating fluid joint 47 to an inlet water supply riser 50. As also shown, lower valve housing 13 contains therein a retainer cap 54 for a spring 56 associated with a bleeder valve 58, as well as a retainer ring 60. In general, valve 40 can assume an open position wherein water is admitted to flow through inlet water supply riser 50, into lower valve housing 13, through conduit 16, and then into main housing 10, as well as a closed position wherein the water supply is prevented from passing valve 40. As will be discussed more fully below, after valve 40 is closed following an open condition, bleeder valve 58 permits water to seep out of main housing 10 and conduit 16 such that, in a non-use condition, no water is retained within sprinkler head assembly 6 above at least frost line A.

Figure 6:
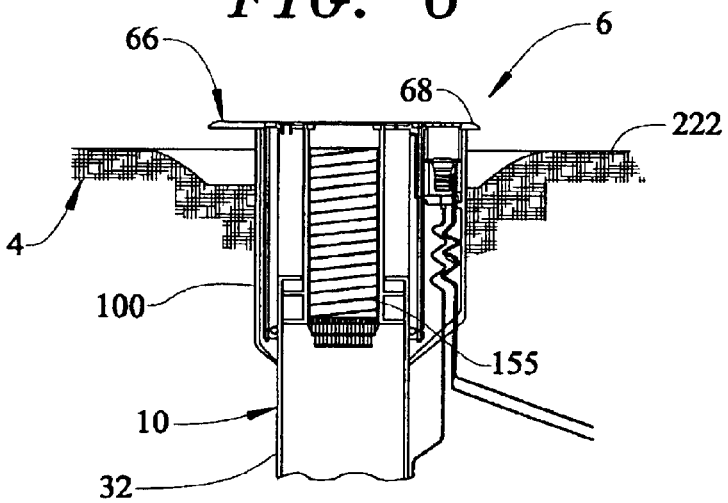
FIG. 6 illustrates the sprinkler head assembly of FIG. 5 in a raised condition.
Figure 7:
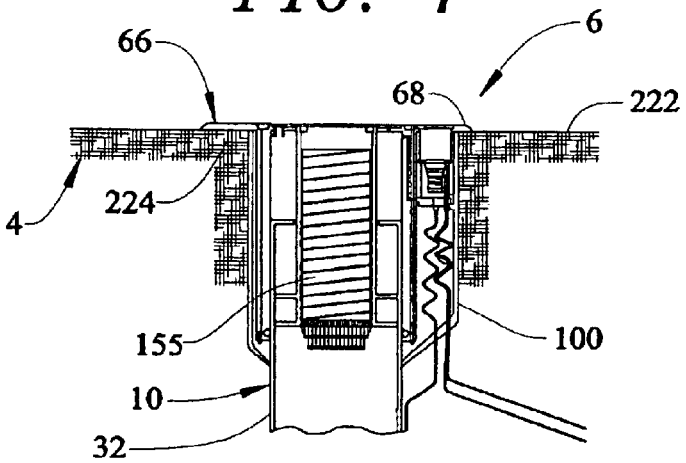
FIG. 7 shows the sprinkler head assembly of FIGS. 5 and 6 in a desired operational position arranged flush with the ground surface.

Sprinkler head assembly 6 also includes a housing cover 66 that is preferably, integrally molded with a top cover portion 68 and a cylindrical body portion 69. Formed in top cover portion 68, directly opposite cylindrical body portion 69, is an annular recess 73. In accordance with the most preferred form of the invention, annular recess 73 has fitted therein a retainer ring 77. Although retainer ring 77 can be formed of various materials, brass is preferably utilized. Extending through both retainer ring 77 and cylindrical body portion 69 at various space circumferential positions are a plurality of through bores 80. Each through bore 80 has position therein an elongated mechanical fastener 85 which, in the most preferred embodiment of the invention, is constituted by an elongated bolt having a threaded end 87. Each end 87 of a respective fastener 85 is threaded into a portion of a compression connector 90 which forms, in combination with a lowermost, inner radial portion (not separately labeled) of cylindrical body portion 69, an annular groove (also not labeled) within which is positioned a O-ring 93. As shown in these Figures, cylindrical body portion 69 fits snugly about cylindrical body portion 32 of main housing 10 but, in fact, can be vertically shifted relative to main housing 10. However, the tightening of elongated mechanical fasteners 85 causes O-ring 93, which is preferably formed of rubber, to be radially compressed, thereby selectively fixing housing cover 66 relative to main housing 10. Further details of the adjustability of housing cover 66 relative to main housing 10 will be provided hereinafter with specific reference to FIGS. 5–7.

Figure 4A:
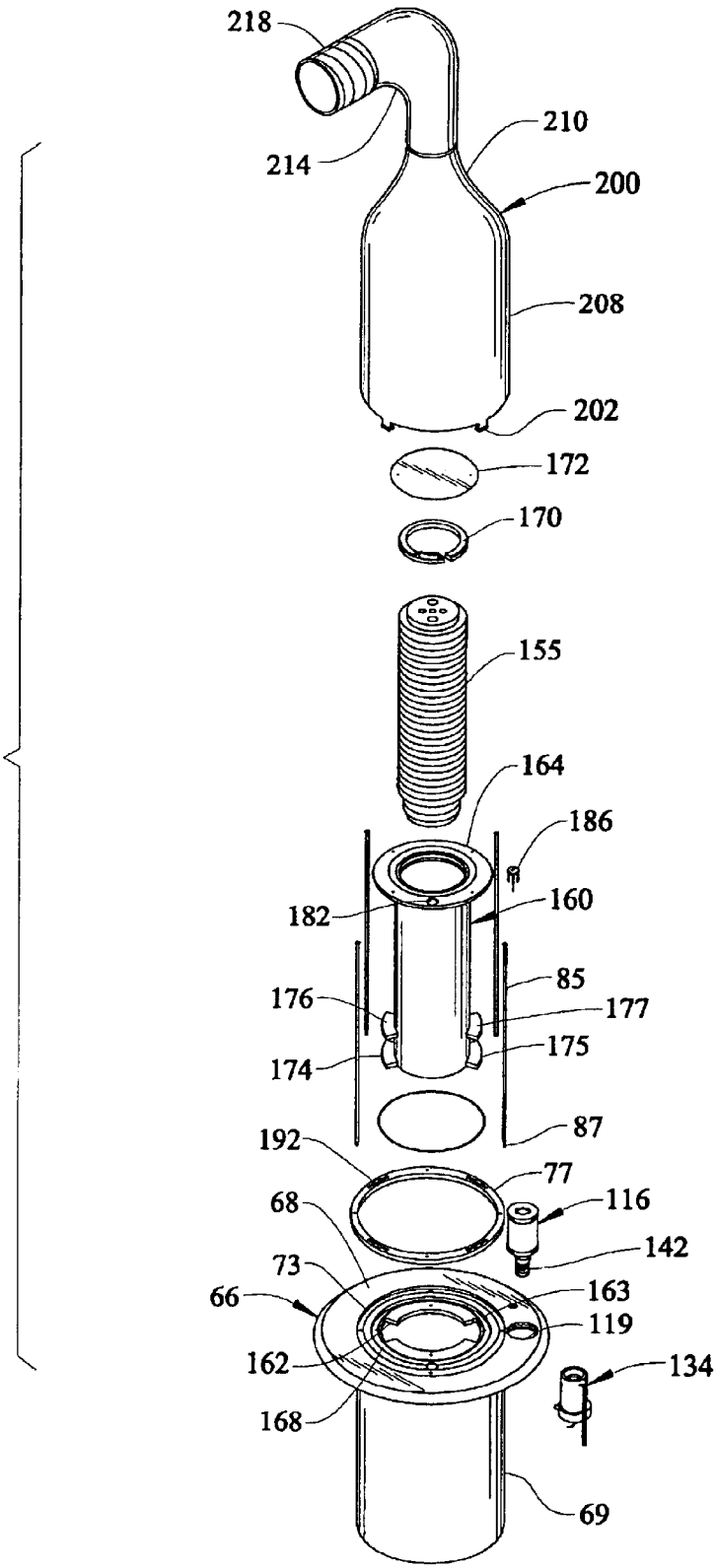
FIG. 4A is an exploded view of certain components of the sprinkler head assembly of the invention.
Figure 4B:
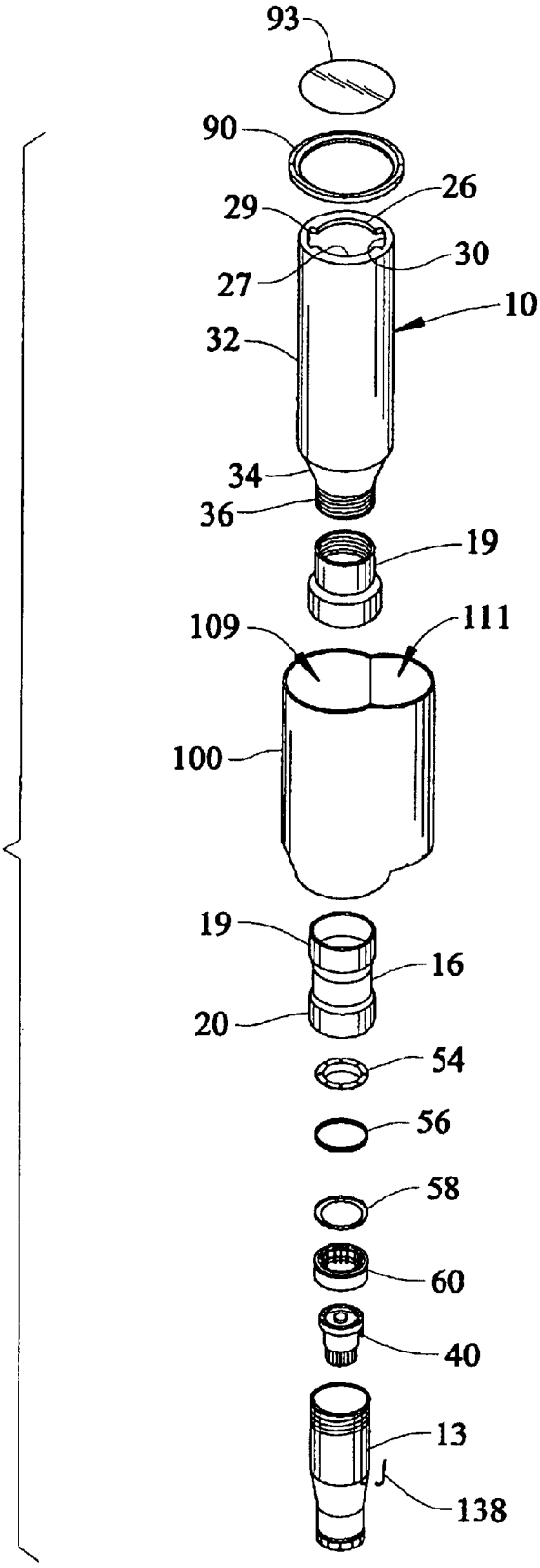
FIG. 4B is an exploded view of other components of the sprinkler head assembly of the invention.

Extending beneath top cover portion 68 and about cylindrical body portion 69 of housing cover 66 is a dirt shield 100. More specifically, dirt shield 100 includes a first end 102 which is preferably fixed to or otherwise moveable with top cover portion 68 and an opposing end defining tapering portions 106 and 107. As best shown in FIG. 4B, dirt shield 100 is actually asymmetrical and defines a main chamber 109 and an offset chamber 111. As clearly shown in these figures, main housing 10 is arranged within main chamber 109 and tapering end portions 106 and 107 directly abut and are preferably biased against main housing 10 to create a seal between dirt shield 100 and main housing 10.

Figure 3:
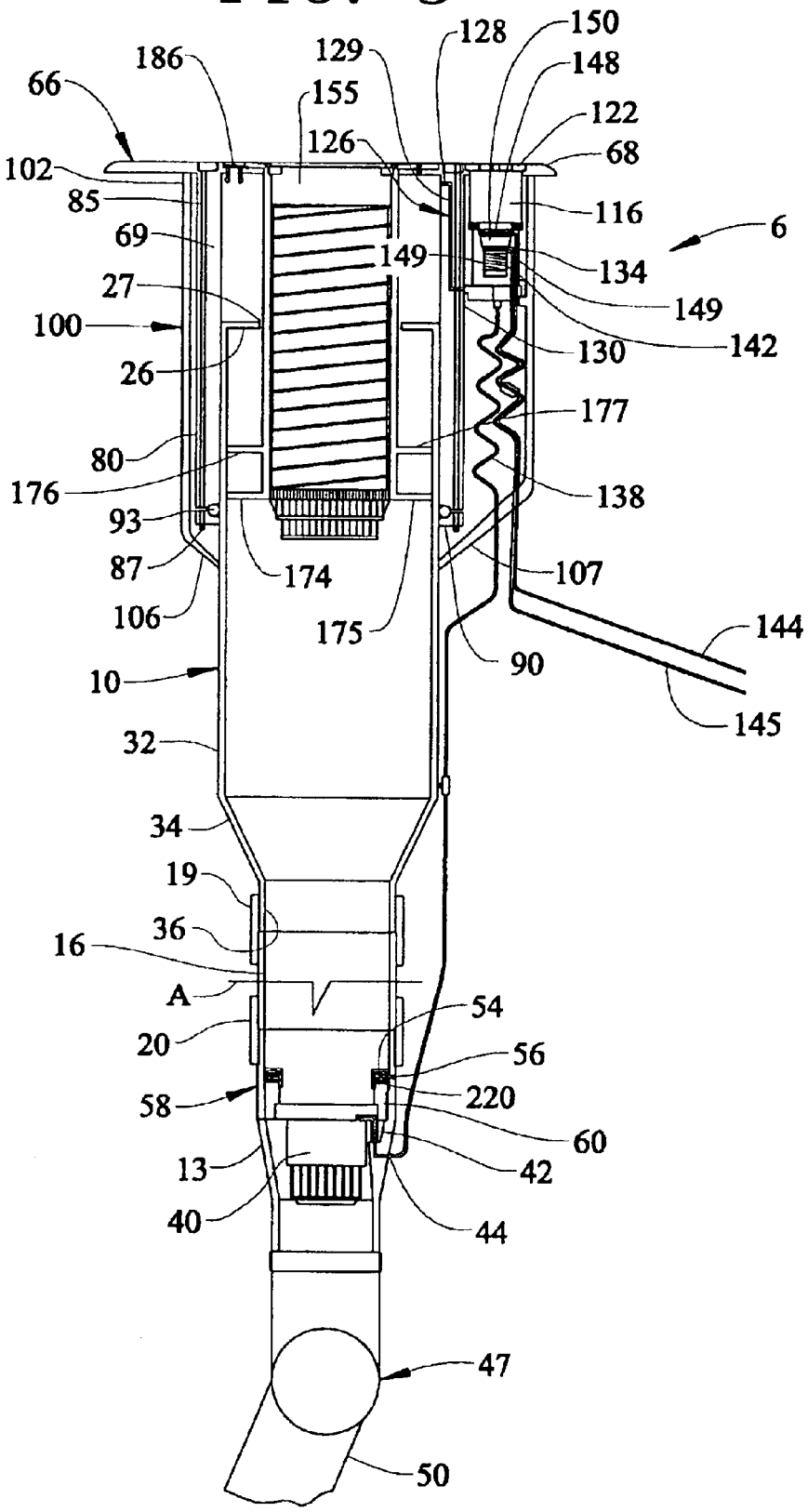
FIG. 3 is a cross-sectional view of the sprinkler head assembly of the invention.

Arranged within offset chamber 111 is a solenoid 116. More specifically, top cover portion 68 of housing cover 66 is formed with an opening 119 within which is received solenoid 116 having a top portion 122. As will be discussed more fully below, solenoid 116 is preferably, threadably mounted. As best shown in FIG. 3, a fluid passage 126, having first, second and third legs 128–130, extends from a zone between in-turn flange 26 of main housing 10 and top cover portion 68. Fluid passage 126 is linked through third leg 130 to a bypass switch housing 134 of solenoid 116. Bypass switch housing 134 also has associated therewith a bleeder line 138 that extends through dirt shield 100 and is in fluid communication with passage 44 as clearly shown in FIG. 3. Bypass switch housing 134 includes an internally threaded socket 140 which threadably receives an externally threaded shank portion 142 of solenoid 116. Bypass switch housing 134 also has associated therewith a pair of electrical leads 144 and 145 for use in activating/de-activating solenoid 116 which, in turn, controls the opening and closing of valve 40. More specifically, solenoid 116 is provided with contact rings 148 and 149 which are spaced by an insulator ring 150. With this construction, solenoid can be screwed into bypass switch housing 134 at top portion 122 and, when top portion 122 becomes flush with top cover portion 68, rings 148 and 149 will automatically make contact with leads 144 and 145. Although not shown, an O-ring preferably extends about top portion 122 for sealing purposes. At this point, it should be recognized that the use of a solenoid arrangement in controlling a main water supply valve of a pop-up sprinkler is quite common in the art. Therefore, note should really be taken of the mounting of solenoid 116 and bypass switch housing 134, as well as the manner in which bypass switch housing 134 is interconnected through bleeder line 138 to valve 40 below frost line A. Again, other types of quick mounting/dismounting engagements for solenoid 116 could be employed. It is simply important to note that solenoid 116 can be readily replaced as needed without re-wiring, splicing or excavating.

Sprinkler head assembly 6 also has associated therewith a spring-loaded sprinkler head unit 155 which is mounted within a head adapter 160. In accordance with the invention, sprinkler head unit 155 can take various forms known in the art without departing from the invention. Head adapter 160 is specifically configured based on the particular sprinkler head unit 155 chosen for use in the overall sprinkler head assembly 6. Therefore, different, known sprinkler head units 155 can be utilized in accordance with the overall invention by simply employing a correspondingly accommodating head adapter 160. In any event, in accordance with the invention, head adapter 160 preferably includes an upper flange 164 that is seated upon a ledge 168 formed in top cover portion 68, with ledge 168 defining a pair of opposing slots 162 and 163 corresponding to slots 29 and 30. A clip 170 is utilized to position sprinkler head unit 155 within head adapter 160. Finally, a cap 172 is also provided.

Of particular note, head adapter 160 is shown to include a pair of lower, radially projecting tabs 174 and 175 and a pair of upper, radially projecting tabs 176 and 177, all of which are configured to be received within slots 162, 29 and 162, 30 respectively. In this manner, head adapter 160 can only extend into a chamber defined within main housing 10 by properly aligning tabs 174–177 with slots 29, 30, 162 and 163. Once head adapter 160 is properly fitted within main housing 10, head adapter is preferably rotated, such as through 90° to misalign tabs 174–177 relative to slots 29 and 30, and then secured in place, such as through the use of screws (not shown) or the like, to top cover portion 68. In the most preferred form of the invention, upper flange 164 of head adapter 160 is provided with an opening 182 within which is removably mounted a water release cap 186, the purpose of which will be detailed more fully below.

In further accordance with the most preferred form of the invention, retainer ring 77 is preferably formed with a plurality of circumferentially spaced slots 192. Slots 192 are provided so as to enable a discharge container 200 to be selectively attached to housing cover 66. More specifically, container 200 is formed with a plurality of circumferentially spaced connection tabs 202 in an open lower portion thereof, with each connection tab 202 being adapted to extend within a respective slot 192 upon the seating of container 200 upon retainer ring 77. Each slot 192 preferably includes an enlarged central opening section which can receive a respective tab 202. Thereafter, container 200 can be rotated a few degrees in either direction wherein each tab 202 is received beneath a portion of retainer ring 77 in a smaller slot section in order to latch container 200 in place upon top cover portion 68. This arrangement advantageously enables a cleaning action to occur within each slot 192 upon rotation of container 200. Regardless, it should be apparent that a wide variety of known quick connect arrangements, including a bayonet-type connection, could be employed between container 200 and retainer ring 77 without departing from the invention. As shown, container 200 includes a main body section 208, a tapering section 210 and an angled end section 214. Angled end section 214 is provided with an externally threaded terminal end 218 which is preferably sized to threadably receive thereon a standard female hose connector such that container 200 defines a hose connection element for sprinkler head assembly 6.

The general operation of sprinkler head assembly 6 will now be described in detail with initial reference to FIG. 3. When it is desired to operate sprinkler head assembly 6, an electrical signal is caused to be directed through leads 144 and 145 to solenoid 116. This signal causes the opening of bypass switch housing 134, thereby fluidly interconnecting the sealed area below top cover portion 68 with valve 40 through passage 44 and bleeder line 138. In this manner, valve 40 is caused to open thereby directing a flow of pressurized water from inlet water supply riser 50, through the articulating joint 47 and valve 40. This water will cause ring 60 to shift against spring 56 such that the water will continue to flow through lower valve housing 13, conduit 16 and into main housing 10. The pressurized water causes sprinkler head unit 155 to pop-up above top cover portion 68 which is preferably, substantially flush with the ground surface as generally shown in FIG. 1.

In a manner known in the art, sprinkler head unit 155 will be caused to spray water in a predetermined pattern, with sprinkler head unit 155 either remaining stationary or rotating during operation. A portion of the water flow will enter fluid passage 126 to act on bypass switch housing 134 in a known manner. When it is desired to terminate the sprinkling operation, an additional signal will be sent through electrical leads 144 and 145, such as through the use of a timer unit (not shown), to de-activate solenoid 116, thereby causing valve 40 to close. Due to the lack of additional water being supplied to main housing 10, the water within main housing 10, conduit 16 and lower valve housing 13, at least above valve 40, will be caused to leak out through bleeder valve 58. That is, once valve 40 is closed, ring 60 is biased to the position shown in FIG. 3 by spring 56 thereby enabling all the water above bleeder valve 58 to seep out of sprinkler head assembly 6 through weep holes (not shown) extending through lower valve housing 13 proximate the height of spring 56. These weep holes are therefore covered when ring 60 is shifted upwardly upon opening of valve 40, but the weep holes of bleeder valve 58 are exposed when valve 40 is closed. Since bleeder valve 58 is located below frost line A, no water is normally maintained within sprinkler head assembly 6 above frost line A. Obviously, this represents a significant advantage in that sprinkler head assembly 6 need not be winterized as there is no concern for freezing of any water within sprinkler head assembly 6 which could cause structural damage thereto.

As indicated above, sprinkler head assembly 6 can accommodate various different known commercial brands of sprinkler head units 155 through the use of respectively configured head adapters 160. Due to the advantageous mounting of head adapter 60 within main housing 10 through the cooperation of tabs 174–177 and slots 29–30, head adapter 160 establishes a built-in stop, in combination with main housing 10, which prevents potential blowouts due to a surge in water pressure or the like. As known in the art, such blowouts can cause substantial flood damage. However, during such an occurrence, tabs 174–177 will be caused to shift relative to main housing 10 so that at least tabs 176 and 177 will abut in-turn flange 26 to prevent the undesired removal of head adapter 160 from main housing 10. That is, since head adapter 160 is rotated following the insertion of tabs 174–177 within slots 29 and 30, the mere vertical shifting of head adapter 160 will not enable head adapter 160 to be released from within main housing 10. Obviously, in order to maintain this feature of the invention, at least one set of corresponding tabs 174, 175 and 176, 177 would desirably be provided on any head adapter employed for a particular sprinkler head unit.

At this point, the easy access to solenoid 116 is reemphasized. Unfortunately, solenoids employed for pop-up sprinklers have a tendency to fail over time and need to be replaced. It is typical to locate a solenoid adjacent the main flow control valve, which would correspond to valve 40. Although such an known valve would be located above the frost line, it is still considered advantageous to have solenoid 116 readily accessible for replacement as needed, as well as to avoid the need to re-wire a new solenoid. The threaded mounting of solenoid 116 and the automatically established electrical connection arrangement provides an advantageous configuration. Furthermore, the incorporation of dirt shield 100 provides an advantageous protective feature which prevents the ingress of dirt to compression connector 90. This is important based on the unique manner in which top cover portion 68 can be vertically shifted relative to main housing 10 as will now be described in detail with particular reference to FIGS. 5–7.

Figure 5:
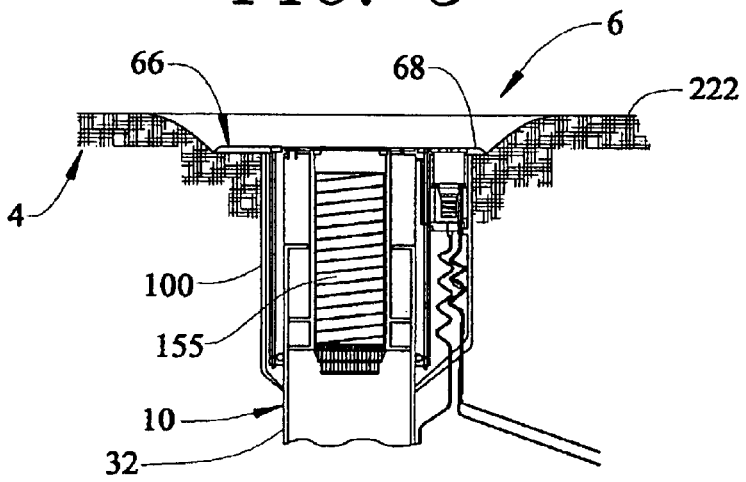
FIG. 5 depicts the sprinkler head assembly of the invention recessed relative to an adjacent ground surface.

As shown in FIG. 5, top cover portion 68 has been undesirably shifted so as to be below the general ground surface represented at 222. This can be caused by many factors, including settling following full installation of the overall sprinkler system or based on top cover portion 68 being trampled upon. In particular, in the case of employing sprinkler head assembly 6 on a golf course, it would not be uncommon for golf carts to ride upon corresponding top cover portions 68 which, at least over time, can cause settling of the ground surface 222 about sprinkler head assembly 6, thereby resulting in a condition illustrated in FIG. 5. Of course, it is considered desirable to maintain a prerequisite positioning of top cover portion 68 substantially flush with ground surface 222. In accordance with the invention, sprinkler head assembly 6 can be vertically adjusted in a quick and simple manner which avoids the need for extensive time and costs associated with excavating about sprinkler head assembly 6, such as all the way down past articulating joint 47, in order to re-establish the desired flush mounting. Therefore, in accordance with the present invention, a groundskeeper or the like need merely loosen mechanical fasteners 85 thereby relieving pressure of the compressed O-ring 93 between cylindrical body portion 69 of housing cover 66 and main housing 10 in order to enable housing cover 66 to be vertically shifted relative to main body 10 to the position shown in FIG. 6. As shown in the various Figures, ample slack is provided for electrical leads 144 and 145, as well as bleeder line 138, to accommodate this relative shifting. In any event, with top cover portion 68 in a position shown in FIG. 6, fill dirt or the like generally indicated at 224 can be provided to raise the recess area to ground surface 222. Thereafter, top cover portion 68 can be lowered to the position shown in FIG. 7, where it can be readily fixed relative to main housing 10 by simply re-tightening elongated mechanical fasteners 85. Certainly, this overall operation only takes a relatively short period of time and has essentially no negative impact on the surrounding grass about sprinkler head assembly 6. During this overall adjustment procedure, shield 100 continues to protect against the undesired ingress of dirt or other debris, particularly that which may hamper the operation of compression connector 90.

In a typical pop-up sprinkler system, particularly those employed in golf courses, it is necessary to provide an auxiliary means to attach a hose for other water supply needs at various locations. Even if a pop-up sprinkler unit was designed to avoid the need to winterize the same, these additional hose connectors are almost invariably on the same overall water supply lines and therefore require drainage of the entire system for winterizing purposes. Instead of requiring additional, dedicated hose connectors (commonly referred to as "snap valves" in the art), sprinkler head assembly 6 preferably accommodates the separate attachment of container 200 in a manner set forth above. That is, container 200 can be selectively sealed against retainer ring 77 through the use of connection tabs 202 and slots 192, as well as a O-ring (not shown) provided on the bottom of container 200. With container 200 fluidly sealed in this manner, activation of sprinkler head assembly 6 as set forth above will cause sprinkler head unit 155 to pop-up inside of container 200. Given the sealed connection between container 200 and top cover portion 68, the water flowing out of sprinkler head unit 155 will be forced to flow out of terminal end 218. As discussed above, terminal end 218 is adapted to be threadably attached to the female connector of a hose. In situations where a greater degree of water pressure is desired, water release cap 186 can be readily removed from top cover portion 68 to expose opening 182 prior to attachment of container 200 onto retainer ring 77. Although only a single water release cap 186 is shown in the preferred embodiment, additional caps could be employed or a larger opening and associated cap could be utilized. In any event, since opening 182 is radially located within the confines of retainer ring 77, all the fluid flowing through opening 182 will also be directed through container 200.

Although described with reference to a preferred embodiment of the invention, it should be readily understood that various changes and/or modifications can be made to the invention without departing from the spirit thereof. In general, it should be recognized that the invention is directed to an advantageously configured, adjustable pop-up sprinkler head assembly used in connection with underground irrigation systems wherein the main flow valve is advantageously located below a frost line, the overall assembly can be utilized in connection with various known types of sprinkler head units due to the employment of a head adapter that also establishes a blow-out feature, the overall sprinkler head assembly can be readily, vertically adjusted, while being protected by the ingress of dirt, in an easy and convenient manner, and the assembly can be readily converted for use in spraying water through a hose. In any event, although the preferred embodiment has been described with particular structure for enabling the vertical adjustability, establishing the blow-out feature, accessing the solenoid, and attaching the hose connecting container, it should be readily apparent that a wide range of constructions could be utilized in accordance with the present invention. Therefore, the invention is only intended to be limited by the scope of the following claims.

We claim:

1. A sprinkler assembly comprising:

a main housing having first and second open ends and an interior chamber, said first end being adapted to receive a flow of water;

an adapter sleeve having a first end portion extending through the second end of the main housing and into the interior chamber, and a second end portion projecting from the main housing;

a sprinkler head unit positioned within the adapter sleeve and shiftably mounted relative to the main housing;

a main valve adapted to direct the flow of water into the main housing and through the sprinkler head unit;

a housing cover including a top cover portion extending across the main housing and a body portion which extends concentrically about the second end of the main housing, said housing cover being selectively shiftable, substantially vertically relative to the second end of the main housing;

means for releasably securing the housing cover relative to the main housing;

an opening formed in the top cover portion of the housing cover, said opening leading to a zone radially outwardly of the main housing;

a switch housing, electrically linked to the main valve, located in the zone; and a solenoid for opening and closing the main valve, said solenoid valve assembly being positioned in said zone, readily removably attached to the switch housing, and accessible through said opening; and a hose connection element sealably mounted to the housing cover about the sprinkler head unit.

2. A sprinkler assembly comprising:

a main housing having first and second open ends and an interior chamber, said first end being adapted to receive a flow of water;

a housing cover including a top portion extending across and being connected to the main housing;

an adapter sleeve having a first end portion, said adapter sleeve extending through both the top portion of the housing cover and the second end of the main housing so as to extend from the top portion of the housing cover and into the interior chamber, and said adapter sleeve having a second end portion projecting from the main housing;

a sprinkler head unit being mounted within the adapter sleeve and being movable relative to the adapter sleeve to allow the sprinkler head unit to rise during operation of the sprinkler assembly; and a main valve adapted to direct the flow of water into the main housing and through the sprinkler head unit.

3. The sprinkler assembly according to claim 2, wherein the second open end of the main housing is formed with at least one slot and the first end portion of the adapter sleeve is provided with at least one tab, wherein said at least one tab needs to be aligned with said at least one slot in order to position the first end portion of the adapter sleeve in the main housing.

4. The sprinkler assembly according to claim 3, wherein the at least one tab is arranged vertically offset from the at least one slot within the main housing such that, if a blow-out condition for the pop-up sprinkler assembly develops, the adapter sleeve is prevented from freely exiting the main housing.

5. The sprinkler assembly according to claim 4, wherein the at least one tab includes a pair of opposing tabs projecting radially from the first end portion of the adaptor sleeve and the at least one slot includes a pair of opposing slots.

6. The sprinkler assembly according to claim 2, wherein the top portion of the housing cover includes a recessed ledge, with the second end portion of the adapter sleeve being positioned on the recessed ledge.

7. The sprinkler assembly according to claim 2, further comprising: a valve housing fluidly connected to the main housing, wherein said main valve is mounted in the valve housing and located below a frost line for the sprinkler assembly.

8. The sprinkler assembly according to claim 7, further comprising: a bleed valve positioned adjacent the main valve below the frost line, said bleed valve being adapted to drain water from the main housing whenever water is prevented from flowing trough the main valve.

9. A sprinkler assembly comprising:

a main housing having first and second open ends and an interior chamber, said first end being adapted to receive a flow of water, a sprinkler head unit mounted within the main housing;

a main valve adapted to direct the flow of water into the main housing and through the sprinkler head unit;

a housing cover including a top cover portion extending across the main housing and a body portion which extends concentrically about the second end of the main housing, said housing cover being selectively shiftable, substantially vertically relative to the second end of the main housing; and means for releasably securing the housing cover relative to the main housing wherein said securing means extends through and is accessible from atop the housing cover.

10. The sprinkler assembly according to claim 9, wherein said securing means enables the housing cover to be fixed relative to the main housing in an infinite number of positions between extreme raised and lowered positions.

11. The sprinkler system assembly according to claim 9, wherein said securing means comprises a compression connector arranged adjacent the main housing and a plurality of mechanical fasteners extending from the housing cover to the compression connector.

12. The sprinkler system assembly according to claim 11, wherein said securing means further comprises an elastomeric O-ring arranged between the body portion of the housing cover and the compression connector, as well as against the main housing, said O-ring being adapted to be pressed into engagement with the main housing to secure the housing cover relative to the main housing.

13. The sprinkler system assembly according to claim 11, wherein each of the plurality of mechanical fasteners extends entirely through the body portion of the housing cover.

14. The sprinkler system assembly according to claim 9, further comprising: a dirt shield extending about the body portion of the housing cover, beneath the top cover portion, said dirt shield being substantially sealed against the main housing at a position below the body portion.

15. The sprinkler system assembly according to claim 14, further comprising;

an opening formed in the top cover portion of the housing cover, said opening leading to a zone radially between the main housing and the dirt shield; and a solenoid linked to the main valve for opening and closing the main valve, said solenoid being positioned in said zone and being directly accessible through said opening.

16. The sprinkler assembly comprising:

a main housing having first and second open ends and an interior chamber, said first end being adapted to receive a flow of water;

a sprinkler head unit shiftably mounted relative to the main housing;

a housing cover including a top cover portion extending across and being connected to the main housing; and a hose connection element sealably mounted to the housing cover about the sprinkler head unit.

17. The sprinkler assembly according to claim 16, wherein the hose connection element constitutes an open ended container including a first open end sealed against the housing cover and a second open end which is externally threaded.

18. The sprinkler assembly according to claim 16, further comprising:

a recess formed in the top cover portion of the housing cover; and a retainer element secured in the recess, said hose connection element being releasably attached to the retainer element.

19. The sprinkler assembly according to claim 18, wherein the retainer element constitutes an annular ring.

20. The sprinkler assembly according to claim 16, further comprising:

an opening formed in the top cover portion, with the opening being exposed to the interior chamber of the main housing, wherein said hose connection element encircles the opening upon being sealably mounted to the housing cover.

21. A sprinkler assembly comprising:

a main housing having first and second open ends and an interior chamber, said first end being adapted to receive a flow of water;

a sprinkler head unit shiftably mounted relative to the main housing;

a main valve adapted to direct the flow of water into the main housing and through the sprinkler head unit;

a housing cover including a top cover portion extending across and being connected to the main housing;

an opening formed in the top cover portion of the housing cover, said opening leading to a zone radially outwardly of the main housing;

a switch housing, electrically linked to the main valve, located in the zone; and a solenoid for opening and closing the main valve, said solenoid being positioned in said zone, readily removably attached to the switch housing, and removable through said opening.

22. The sprinkler assembly according to claim 21, wherein the solenoid is threadably attached to the switch housing.

23. The sprinkler assembly according to claim 22, further comprising:

a threaded socket provided in the switch housing; and a threaded shank provided on the solenoid, said solenoid being threadably attached to the switch housing with the threaded shank being received in the threaded socket.

24. The sprinkler assembly according to claim 22, further comprising: electrical leads extending from the switch housing to the main valve, said solenoid being automatically, electrically connected to the electrical leads upon threadably attaching the solenoid to the switch housing.

* * * * *